US007481016B2

(12) United States Patent
Gonzalez

(10) Patent No.: US 7,481,016 B2
(45) Date of Patent: Jan. 27, 2009

(54) OPTICAL SIGHT MOUNTING APPARATUS FOR FIREARMS

(75) Inventor: Marco E. Gonzalez, Murrieta, CA (US)

(73) Assignee: Global Defense Initiatives, Inc., Temacula, CA (US)

( * ) Notice: Subject to any disclaimer, the term of this patent is extended or adjusted under 35 U.S.C. 154(b) by 164 days.

(21) Appl. No.: 10/845,340

(22) Filed: May 13, 2004

(65) Prior Publication Data

US 2005/0252060 A1 Nov. 17, 2005

(51) Int. Cl.
*F41G 1/38* (2006.01)

(52) U.S. Cl. ..... 42/127; 42/124; 42/125

(58) Field of Classification Search ..... 42/124–128
See application file for complete search history.

(56) References Cited

U.S. PATENT DOCUMENTS

| | | | | |
|---|---|---|---|---|
| 4,845,871 | A | 7/1989 | Swan | |
| 5,276,988 | A | 1/1994 | Swan | |
| 5,590,484 | A * | 1/1997 | Mooney et al. | 42/111 |
| 5,606,818 | A | 3/1997 | Hardee | |
| 5,941,489 | A * | 8/1999 | Fanelli et al. | 248/298.1 |
| 6,381,895 | B1 | 5/2002 | Keeney et al. | |
| 6,449,893 | B2 | 9/2002 | Spinner | |
| 6,499,245 | B1 * | 12/2002 | Swan | 42/71.01 |
| 6,508,027 | B1 | 1/2003 | Kim | |
| 6,606,813 | B1 | 8/2003 | Squire et al. | |
| 6,629,381 | B1 * | 10/2003 | Keng | 42/124 |
| 6,722,074 | B1 * | 4/2004 | Farrell | 42/124 |
| 2001/0022044 | A1 * | 9/2001 | Spinner | 42/124 |
| 2001/0045046 | A1 | 11/2001 | Otteman | |
| 2003/0106251 | A1 | 6/2003 | Kim | |
| 2003/0140546 | A1 * | 7/2003 | Kay | 42/133 |
| 2004/0000083 | A1 * | 1/2004 | Grant, Jr. | 42/112 |
| 2005/0000142 | A1 * | 1/2005 | Kim et al. | 42/124 |
| 2005/0039369 | A1 * | 2/2005 | Wilson | 42/124 |
| 2005/0229465 | A1 * | 10/2005 | Dextraze | 42/85 |
| 2005/0241211 | A1 * | 11/2005 | Swan | 42/124 |
| 2006/0064913 | A1 * | 3/2006 | Gablowski et al. | 42/72 |

OTHER PUBLICATIONS

Atlantic Research Marketing Systems, Inc. rifle scope catalog (http://www.odspec.com/mounts/mounts.html), retrieved Sep. 8, 2006.*
Trijicon Acog Advanced Combat Optical Gunsights, 2003.
A.R.M.S. #18 M21/14 Scope Mount, Exact Date Unknown.
A.R.M.S. #19acog Throw Lever Mount, Exact Date Unknown.

* cited by examiner

*Primary Examiner*—Troy Chambers
(74) *Attorney, Agent, or Firm*—Gordon & Rees, LLP

(57) ABSTRACT

A mounting apparatus for mounting an optical sight on a rifle has an elongated rail and a mounting base projecting downwardly from the rail for securing the rail on a rifle. The rail has an upwardly facing channel extending along its length for receiving a mounting element of a first type of optical sight, the base of the channel having a plurality of openings for receiving fastener devices for selectively securing an optical sight at a selected location along the length of the rail. The opposite sides of the rail each have a plurality of spaced tabs forming a Picatinney rail for mounting a second type of optical sight having a mounting element for engaging over the Picatinney rail. The mounting rail therefore combines the mounting formations for two different types of optical sight in a single rail.

17 Claims, 6 Drawing Sheets

OPTICAL SIGHT MOUNTING APPARATUS FOR FIREARMS

BACKGROUND OF THE INVENTION

The present invention relates generally to a mounting device for a firearm, and is particularly concerned with a mounting device for mounting an accessory such as an optical sight on a firearm.

There are many different types of optical sights or telescopic sights for mounting on firearms such as rifles. Such devices are typically secured to a rail or adapter, which in turn is secured to the rifle itself. One well known adapter for mounting certain types of optical scopes or sights on a rifle is the so-called "Picatinney" rail, which is a straight rail having spaced lugs extending along opposite sides of the rail, with a gripping chamfer on the outer face of each row of lugs. This is designed to engage with a corresponding channel on the base of the optical scope or sight. The Picatinney rail will work with most optical sights currently available. A Picatinney type of mounting rail is described in U.S. Pat. No. 6,381,895 of Keeney et al. and U.S. Pat. No. 6,449,893 of Spinner, for example.

Another well known optical sight is the ACOG® or Advanced Combat Optical Gunsight made by Trijicon Inc. of Wixam, Mich. This gunsight cannot be mounted directly on a Picatinney rail since it has a different mounting assembly of a lug designed to engage in a channel. The current mounting solution is to mount an adapter on top of a Picatinney rail to accommodated the ACOG® optical sight. One problem with this arrangement is that use of an adapter on top of the mounting rail raises the height of the optical sight above the center bore of the rifle to an unacceptable level, requiring the shooter to raise their head unnaturally to obtain a sight picture. This will reduce shooting accuracy. Also, the adapter creates a weak link in the assembly which adds further attachment points which could loosen. It is important for accuracy that the optical sight remains rigidly attached to the rifle.

Another problem inherent in previous mounting rails and adapters for mounting optical sights on rifles is that the optics are typically positioned too far forward, at a distance exceeding the required eye relief range of one to three inches from the shooter's eye to the sight. This causes the shooter to try to crane his or her head forward to distance themselves at the appropriate spacing from the ocular end of the sight.

SUMMARY OF THE INVENTION

It is an object of the present invention to provide a new and improved mounting apparatus for mounting an optical or telescopic sight on a rifle or the like.

According to one aspect of the present invention, a mounting apparatus for mounting an accessory such as an optical sight on a rifle is provided, the apparatus comprising an elongate rail having a forward end, a rear end, and opposite sides, and a mounting base projecting downwardly from the rail for securing the rail on a rifle, the rail having an upwardly facing channel extending along its length for receiving a mounting element of a first type of optical sight, the channel having a base having a plurality of openings for receiving fastener devices for selectively securing an optical sight at a selected location along the length of the rail, and the opposite sides of the rail each having a plurality of spaced tabs and together comprising a Picatinney rail for mounting a second type of optical sight compatible with the Picatinney rail.

The channel is of predetermined shape and dimensions for mounting of ACOG® gunsights as manufactured by Trijicon Inc. of Wixam, Mich. The channel has a flat, horizontal base and opposite side walls which are inclined outwardly from the base at a predetermined angle. The angle of the channel side walls may be of the order of 43 to 45 degrees to match the angle of the ACOG® gunsight mount. The rail lugs or tabs extending along the entire length of the rail define angled outer side rail faces which are also inclined at the standard Picatinney rail orientation. As used herein, Picatinney rail means a rail with spaced ribs or tabs as specified in MIL-STD-1913 (also known as § 1913 Picatinney rail system). The mounting apparatus has a single mounting rail which is adapted for mounting different types of sights or scopes, without requiring a special adapter to be mounted on top of a standard Picatinney rail as was necessary in the past. By combining a Picatinney rail with a channel mount in one integral mounting device, the problems of mounting a separate adapter are avoided, and the optical sight can be mounted at a lower position relative to the rifle. The shooter therefore will not have to crane their head unnaturally in order to get a good picture.

In an exemplary embodiment of the invention, the mounting apparatus is adapted for securing on top of an M1A, M14 or M21 rifle, and uses the standard accessory mounting structures of this type of rifle. The M14/M1A receiver body has a dovetail channel for receiving a stripper clip mechanism used for ammunition loading, as well as a threaded mounting bore on one side for a side mounted accessory. Both of these structures are used to connect the mounting apparatus of this invention to the receiver body. In this embodiment, the mounting base has a dovetail jaw designed for sliding engagement in the dovetail channel of the receiver body, and at least one screw is provided for tightening the jaw on engagement in the channel. In an exemplary embodiment of the invention, two access ports are provided for the dovetail mounting slot, one on each side of the channel, and aligned with bores in the dovetail jaw. A set screw is engaged through each port into the dovetail jaw. These screws are tightened to secure the dovetail jaw in the dovetail recess. Because the set screws are each positioned to one side of the mounting channel or rail, rather than having a single central port and set screw in the base of the channel, they permit the rail to be mounted readily on the receiver body even when the scope or sight is in position on the rail, where it would otherwise make access to a port in the base of the channel difficult or impossible. The dovetail jaw provides an attachment or contact point between the mounting rail and receiver body The base also has a downwardly projecting side wall having an opening for alignment with the mounting bore on the side of the receiver body, and a fastener screw engages through the opening and into the mounting bore in order to provide a second connection between the mounting apparatus and the rifle. A third contact point may be provided between the rail and receiver body for better stability of the mounting rail. A threaded bore may be provided through the base of the channel at the forward end of the rail. A set screw with a resilient tip is secured through this bore and may be extended to contact and bear against the upper surface of the receiver body. The three spaced attachment or contact points provide for a very stable and secure base for an optical sight.

The combined mounting rail and channel is extended rearwardly from the mounting base attachment to the rifle for a distance longer than in a conventional Picatinney rail mount, such that the rail extends over the existing rifle rear mount. This permits optical sights to be positioned on the rail closer to the shooter's eye, at the optimum eye relief distance. The shooter will not have to crane their neck forward in order to obtain a good view, and they will therefore be able to maintain a more comfortable position, which is very important for precision shooting. A recess may be provided in the lower face of the rail at a predetermined location to provide clearance for the standard rifle rear sight.

The mounting apparatus of this invention allows for both ACOG® and 1913 Picatinney rail system compatible optics to be mounted on the same mounting rail, without requiring any additional adapter. It also allows the optics to be mounted closer to the shooter's eye at the appropriate eye relief distance, and reduces the height above the rifle bore. This allows the shooter to hold their head at a comfortable position and also potentially will improve accuracy.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which:

FIG. 6 is a bottom plan view of the mounting rail;

FIG. 7 is a front elevational view of the mounting rail;

FIG. 8 is a view illustrating the front contact point between the mounting rail and receiver body;

DETAILED DESCRIPTION OF THE DRAWINGS

Figure 10:
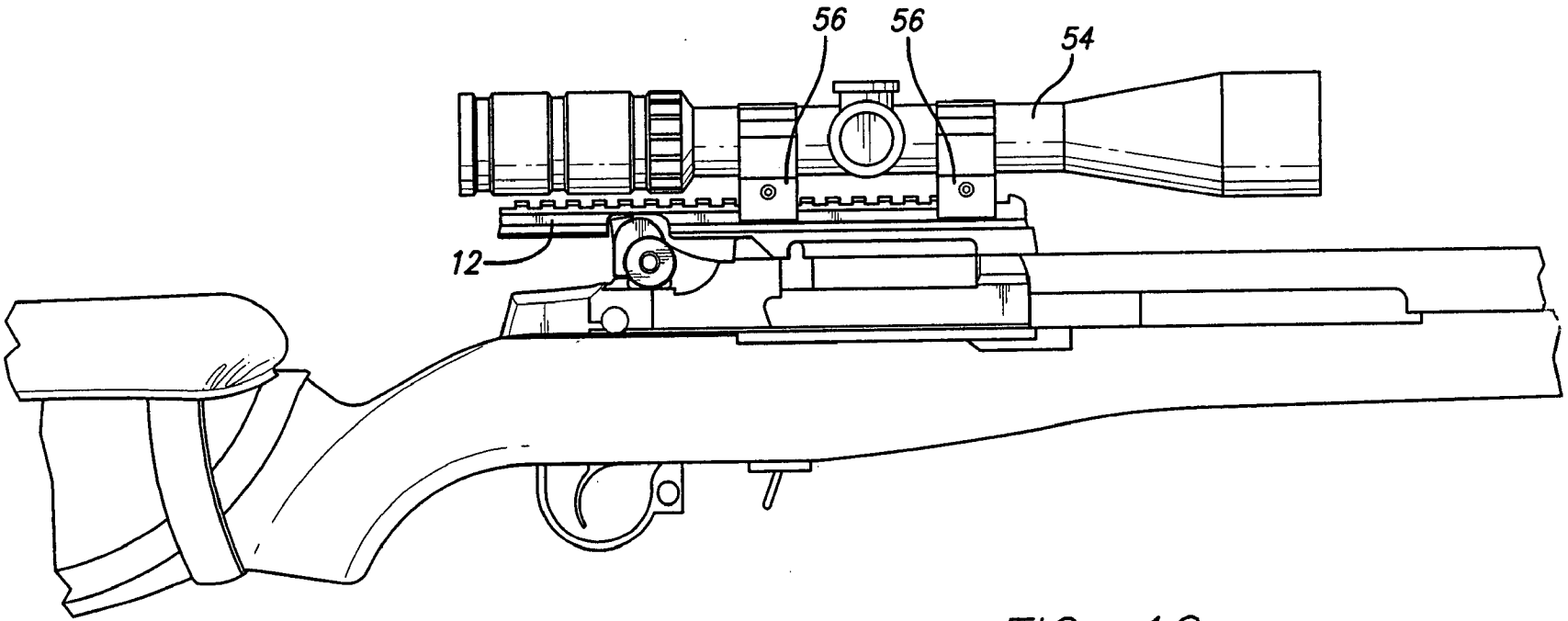
FIG. 10 is a side elevational view similar to FIG. 7 illustrating a Picatinney type optical scope mount engaging over the Picatinney rail tabs of the mounting rail.
Figure 11:
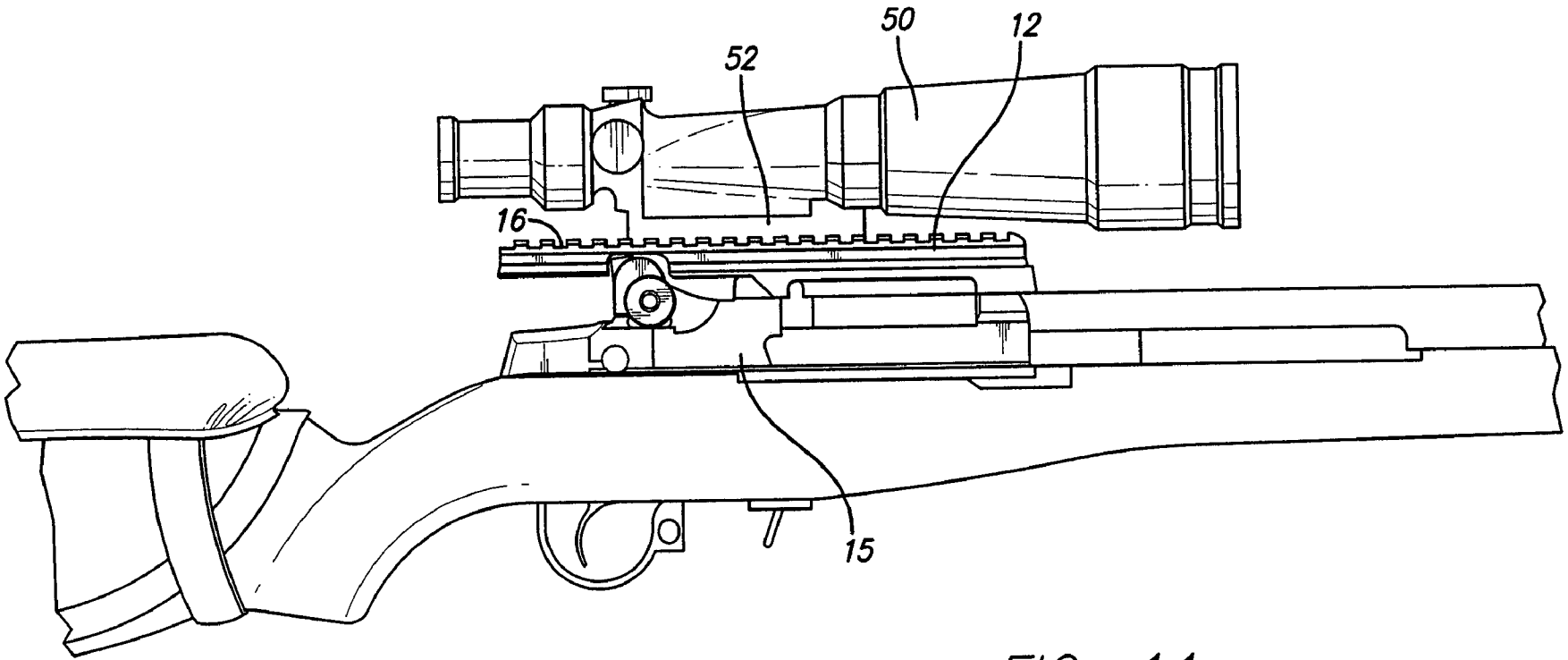
FIG. 11 is a side elevational view similar to FIG. 7 illustrating an ACOG® type scope mounted on the rail.

The drawings illustrate a mounting apparatus 10 according to an exemplary embodiment of the invention for mounting an auxiliary or add-on optical sight on a rifle. FIGS. 1 to 4 illustrate the mounting rail apparatus, while FIGS. 5 to 8 illustrate the apparatus mounted on top of a rifle receiver body 15, and FIGS. 10 and 11 illustrate different types of optical sight mounted on the rail. The mounting rail apparatus basically comprises an elongate mounting rail 12 with an integral, downwardly projecting mounting base 14 for securing the rail on top of a rifle receiver body 15, as best illustrated in FIGS. 5 to 8.

Figure 1:
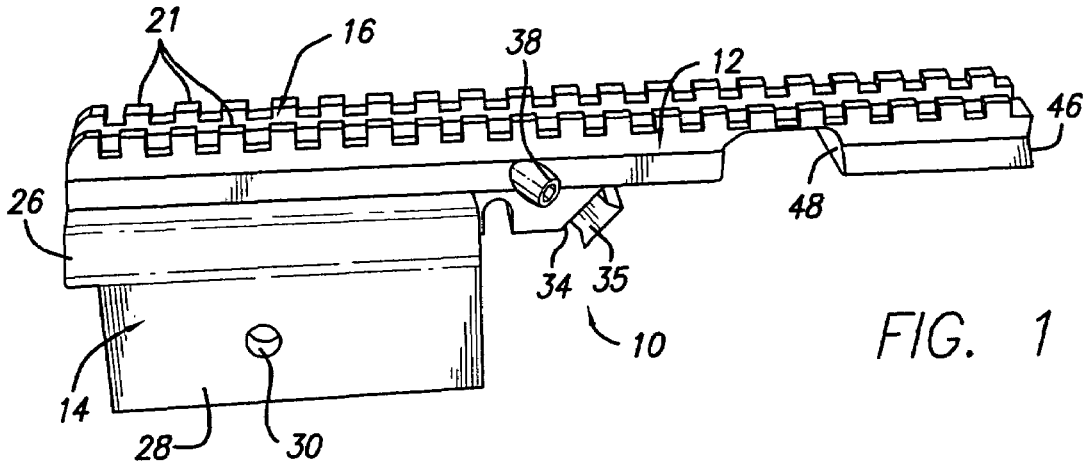
FIG. 1 is a perspective view of a mounting rail for an optical sight according to an exemplary embodiment of the invention.
Figure 2:
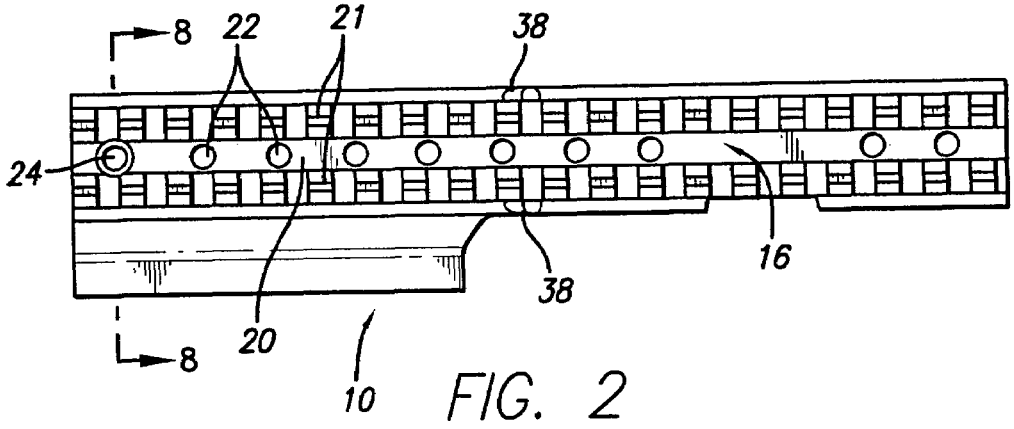
FIG. 2 is a top plan view of the rail of FIG. 1.
Figure 3:
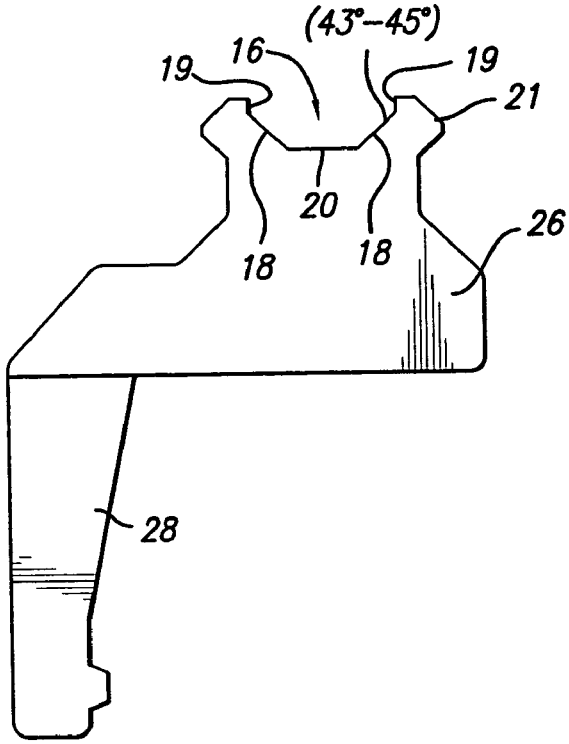
FIG. 3 is an end elevation view of the mounting rail of FIGS. 1 and 2.
Figure 4:
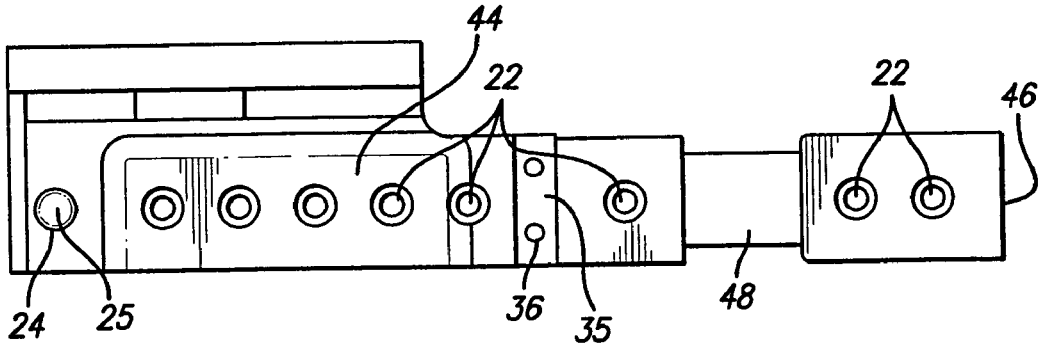
FIG. 4 is a bottom plan view of the rail of FIGS. 1 to 3.

As best illustrated in FIGS. 1 to 3, the mounting rail 12 has an upwardly facing channel 16 having a base wall 20 and outwardly tapered side walls 18 each at an angle of around 43 to 45 degrees, and a series of spaced recoil lugs or tabs 21 along opposite sides of the channel. The lugs or tabs 21 are oriented perpendicular to the longitudinal axis of the rail and, as best seen in FIG. 3, have a predetermined outer surface shape for mating engagement with Picatinney rail compatible optics which have a base recess or mounting slot of mating shape and dimensions. The spaced lugs or tabs define a so-called Picatinney rail as specified in MIL-STD-1913. The side walls of the channel each have an upper, generally vertical rim portion 19 at the location of each tab or lug 21, as illustrated in FIG. 3. In an exemplary embodiment of the invention, the depth of the channel from the upper end of a tab 21 is of the order of 0.18 to 0.22 inches, while the height of a tab above the side wall of the channel between adjacent tabs (i.e. the height of the slot or gap between adjacent tabs 21 is of the order of 0.126 inches and the width of the gap between adjacent tabs is of the order of 0.212 inches.

The base wall 20 of the channel has a series of spaced openings 22 for receiving fastener screws for securing an ACOG® type optical sight at a selected location in the channel, as best seen in FIG. 2. A forward threaded opening 24 adjacent the front end of the channel receives a set screw 25 with a polymer or other resilient material tip 26. When the mounting base 14 is secured on the receiver body 15, the set screw 25 can be adjusted to extend through the rail until it contacts the top surface of the receiver body, as illustrated in FIG. 8.

Figure 5:
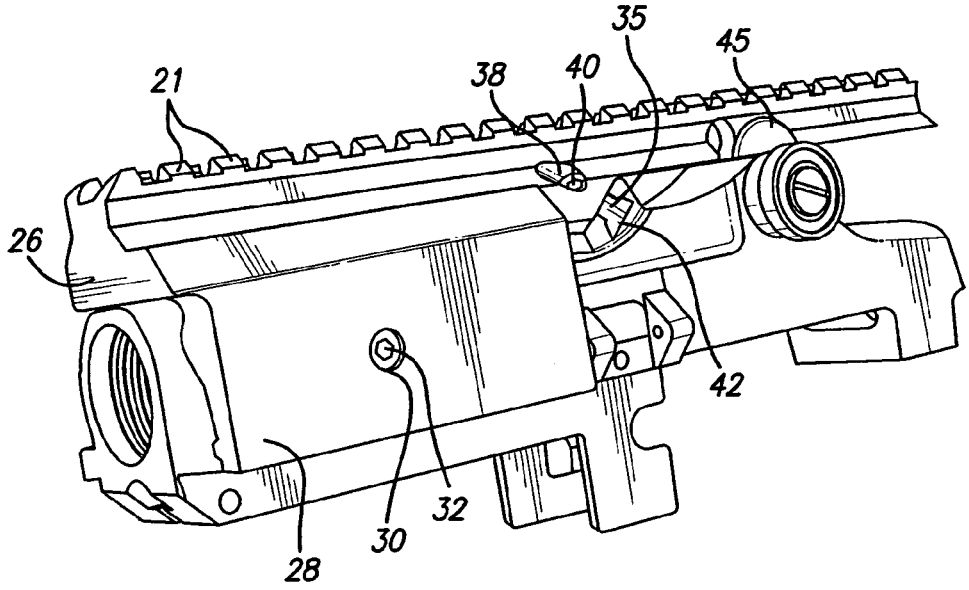
FIG. 5 is a perspective view of the rail of FIGS. 1 to 4 mounted on a rifle receiver body.
Figure 6:
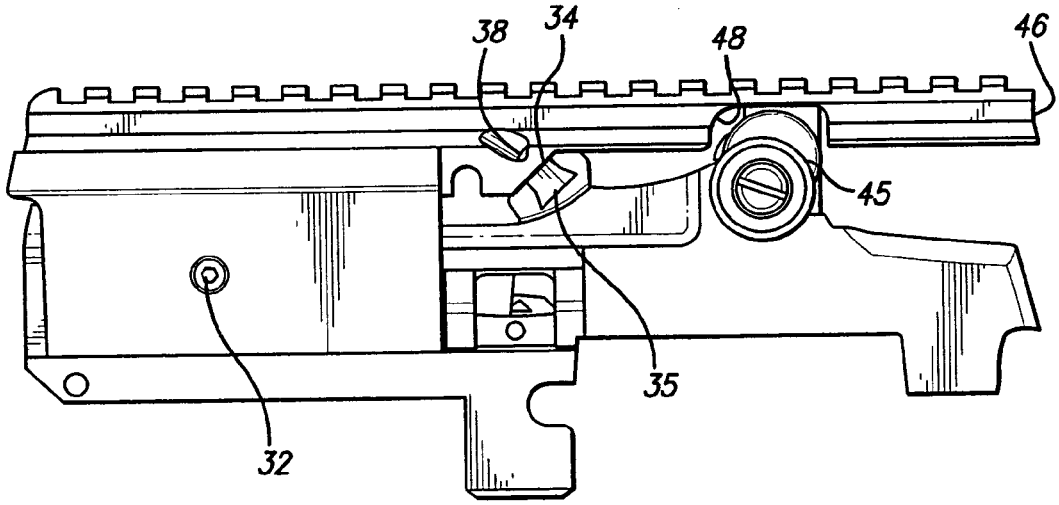
FIG. 6 is a side elevational view of one side of the rail on the receiver body.

The mounting base 14 has an elongate body portion 26 extending beneath the mounting rail 12 from the front end of the apparatus, and projecting outwardly to one side of the mounting rail as indicated in FIG. 3. A side flange 28 projects downwardly from the outwardly projecting side portion of the mounting base. This is designed to project down over one side of the receiver body 15 when the mounting base is mounted onto the body, as illustrated in FIGS. 5 and 6, and has an opening 30 positioned to align with a threaded hole in the side of the receiver body. The threaded hole is conventionally used for side mounting of accessories on the rifle receiver body. A fastener screw 32 is engaged through opening 30 and tightened in the threaded hole in the receiver body in order to secure the mounting rail to the receiver body at a first position.

Figure 7:
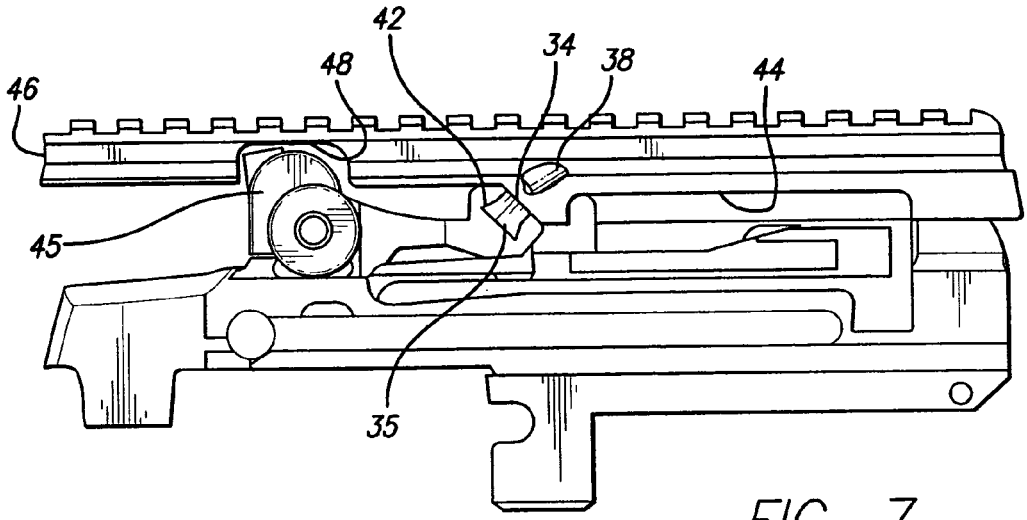
FIG. 7 is a side elevational view illustrating the opposite side of the rail when mounted on the receiver body.

The mounting base also has an inclined rearwardly facing surface 34 having a recess or slot in which one end of a male dovetail lug or jaw 35 is engaged. The dovetail lug 35 has two threaded bores 36 (visible in FIG. 4) which are aligned with two side access ports 38 positioned on opposite sides of the mounting rail. Access ports 38 extend through from the upper side of the mounting base into the dovetail lug receiving recess. The two access ports 38 can be seen in FIGS. 1,2 and 7. A pair of set screws 40 extend through the respective ports 38 and into the receiving bores 36 in the dovetail lug in order to hold the lug in position. The male dovetail lug 35 is designed for engagement in a dovetail recess 42 on the receiver body, as best illustrated in FIGS. 5 to 7. Once the lug 35 is engaged in the recess, the set screws 40 are tightened to draw the lug inwardly and move the opposing, matching inclined faces of the mounting base and the receiver body into close, face-to-face engagement, providing a second attachment/contact point between the rail and the receiver body. The positioning of the tightening screws on opposite sides of the rail allows the dovetail lug or jaw to be tightened easily, even when the optics are in place on the rail.

Figure 8:
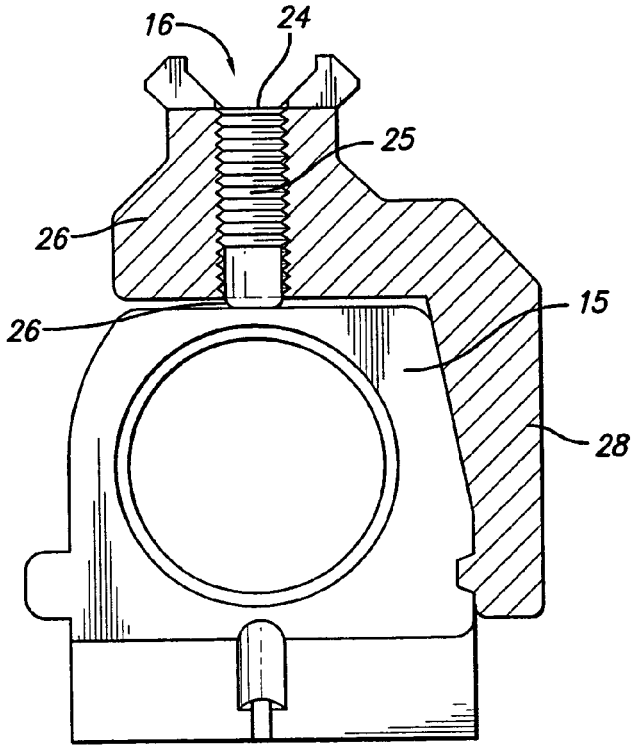
FIG. 8 is a sectional view on the lines 8-8 of FIG. 2 with the rail on the receiver body, illustrating the engagement of the set screw with the upper surface of the receiver body.

A third contact point between the rail and receiver body is provided as illustrated in FIG. 8, by extending the nylon tipped set screw 25 through bore 24 until it protrudes from the lower face of the rail and bears against the opposing upper surface of the receiver body. The three contact/attachment points, i.e the screw fastener 32 extending through the side opening 30, the dovetail lug or jaw 35 engaging in the dovetail recess 42, and the set screw 25 engaging the receiver body, will resist any movement or wobbling of the mounting rail relative to the rifle receiver body, providing a very secure and stable base for an optical sight.

The body portion 26 of the receiver body is cut away to form an indented or recessed region 44 (see FIGS. 4 and 7) in the undersurface of the mounting base. This reduces the amount of material required and the weight of the apparatus, and also provides clearance for the receiver ejection port, so that ejected shells do not hit and damage the base.

Figure 9:
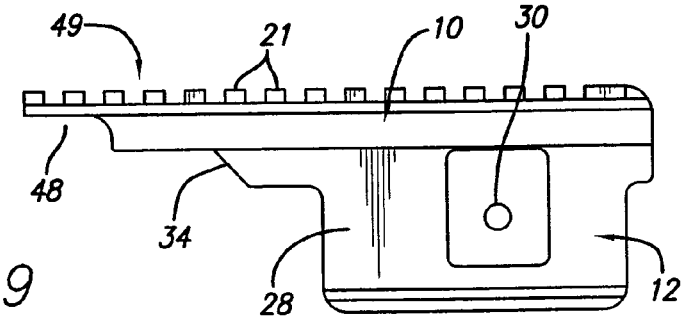
FIG. 9 is a side elevational view illustrating a mounting rail apparatus according to another embodiment of the invention.

The mounting rail has a rear portion which extends rearwardly from the mounting base and over the existing sight 45 of the rifle, so that the rear end 46 of the mounting rail is positioned closer to the shooter. The overall length of the mounting rail is suitably in the range from around six inches to nine inches. The lower face of the mounting rail is provided with an indent or clearance recess 48 at a location corresponding to the existing rifle sight 45, so that the mounting rail can extend over the sight 45 without interfering with it. In the first embodiment illustrated in FIGS. 1 to 8, the length of the rail is of the order of eight inches, making it significantly longer than any prior art sight mount, and the rear portion extends around three to four inches rearwardly from the rear mounting face 34 of the mounting base. FIG. 9 illustrates a mounting rail 49 according to another embodiment of the invention. In this version, the rearwardly extending portion of the rail is shorter, and it terminates adjacent the rifle sight 45 and rifle sight clearance recess 48. The mounting apparatus in this embodiment is otherwise identical to the first embodiment and like reference numerals have been used for like parts as appropriate. The mounting rail in FIG. 9 is about two inches shorter than in the first embodiment.

The mounting apparatus illustrated in the drawings is particularly designed for mounting on top of an M1A, M14, or M21 rifle, with FIGS. 5 to 7 illustrating the apparatus mounted on an M14 rifle receiver body. It will be understood that the mounting base may be modified for mounting on other types of rifle. The integral rail and mounting base may be made of any sufficiently rigid and strong material, such as aluminum, steel or titanium or other similar strength metals, or strong plastics or ceramic materials. For example, the mounting rail may be made from 6061T6 extruded aluminum, 8620 cast steel, 4140 or 4340 tool steel, or 6AL 4V titanium.

The mounting rail 12 combines a mounting channel of the type required for receiving an ACOG® gunsight base with Picatinney rail lugs for mounting a Picatinney type optic or gunsight. Thus, the mounting rail is adapted for mounting different types of sights or scopes directly on the rail. FIG. 11 illustrates an ACOG® gunsight or scope 50 with a mounting base 52 engaged in the channel 16 and secured by screws extending through selected mounting holes 22. FIG. 10 illustrates an optical sight 54 having Picatinney mounts 56 engaged over the Picatinney rail lugs. It can be seen that, in each case, the optics can be positioned close to the shooter's eye, at an optimum, comfortable eye relief distance, improving accuracy. The shooter will not have to crane their neck forward in order to obtain a good view, and they will therefore be able to maintain a more comfortable position, which is very important for precision shooting. The scopes or optical sights 50 and 54 can be positioned in any desired location along the mounting rail 12, as desired by the shooter for optimum eye relief. This provides a greater range of adjustability than was possible in prior sight mounting rails.

The mounting apparatus or device of this invention allows for both ACOG® and 1913 Picatinney rail system compatible optics to be mounted on the same mounting rail, without requiring any additional adapters. The rail is extended rearwardly closer to the shooter's eye, with a clearance recess in the lower face of the rail to provide clearance for the standard rifle rear sight, so that the standard sight does not have to be removed to allow the rail to be mounted. This provides a greater range of sight position adjustment, as well as permitting the optics to be positioned much closer to the shooter's eye than was possible with prior art sight mounts. The apparatus also provides three contact points between the rail and the rifle receiver body, providing a very stable and secure base for an optical sight.

Although some exemplary embodiments of the invention have been described above by way of example only, it will be understood by those skilled in the field that modifications may be made to the disclosed embodiments without departing from the scope of the invention, which is defined by the appended claims.

I claim:

1. A mounting apparatus, comprising:

an elongated rail having a forward end with a threaded bore extending therethrough, a rear end, and opposite sides;

the rail having an upwardly facing channel having a base wall and outwardly tapered side walls, the upwardly facing channel extending along the length of the rail for receiving a mounting lug of an ACOG optical sight, the channel having a base having a plurality of spaced openings projecting upwardly through the bottom of the base for receiving fastener devices for selectively securing the lug of an ACOG optical sight into the bottom of the base within the channel at a selected location along the length of the rail the plurality of spaced openings each having a counterbore at their bottom ends, the upwardly facing channel having a forward threaded opening for receiving a set screw therethrough; and the opposite sides of the rail each having a plurality of spaced tabs and together comprising a Picatinny rail.

2. The apparatus as claimed in claim 1, further comprising a mounting flange projecting downwardly from the rail for securing the rail, wherein the rail and mounting flange are formed integrally.

3. The apparatus as claimed in claim 2, wherein the mounting flange and rail have at least three spaced access ports for receiving fastener devices for contacting a receiver body when the apparatus is mounted on the body of a device.

4. The apparatus as claimed in claim 2, wherein the mounting flange has a side flange projecting downwardly at a location spaced to one side of the mounting rail, the side flange having an opening for alignment with a threaded accessory attachment bore in a side of a device body on which the apparatus is mounted.

5. The apparatus as claimed in claim 2, wherein the mounting flange has a rearwardly directed, inclined mounting surface and a male dovetail adjustably mounted in the mounting flange to project outwardly from the inclined surface, the dovetail being of predetermined shape and dimensions for slidable mating engagement in a dovetail channel of the device body.

6. The apparatus as claimed in claim 5, including at least one fastener device for adjustably tightening the dovetail.

7. The apparatus as claimed in claim 6, wherein the mounting flange has an upper surface opposite to said rearwardly directed, inclined mounting surface, said mounting surface having a recess in which said dovetail is mounted, and at least two access ports extending from said upper surface into said recess on opposite sides of said rail, said dovetail having at least two threaded bores aligned with said access ports, and at least two fastener devices comprising a pair of set screws, each set screw extending through a respective one of said access ports and threadably engaged in the bores in said dovetail.

8. The apparatus as claimed in claim 7, wherein the mounting rail has a rear portion extending rearwardly from said inclined mounting surface.

9. The apparatus as claimed in claim 2, wherein the mounting rail has a rear portion extending rearwardly from said mounting flange, the rear portion having a lower face, and the lower face having a clearance recess at a predetermined location for clearing a standard rear sight when the apparatus is mounted on a device body.

10. The apparatus as claimed in claim 2, wherein the mounting rail has a rear portion extending rearwardly from said mounting flange, the rear portion being adapted to extend over a standard rear sight when the apparatus is mounted on a device body.

11. The apparatus as claimed in claim 1, wherein the channel has a base wall and opposite side walls which are each inclined outwardly at an angle of around 43 degrees to 45 degrees.

12. The apparatus as claimed in claim 11, wherein each side wall has an upper, generally vertical rim at the location of each tab.

13. The apparatus as claimed in claim 1, wherein the rail has a forward end, a rear end, and a lower face, a front, threaded opening extending through the rail adjacent the forward end, and an adjustment screw is threadably engaged in the front opening of the rail, the adjustment screw extending through the lower face of the rail for bearing against an upper surface of a device body on which the apparatus is mounted.

14. The apparatus as claimed in claim 13, wherein the adjustment screw has a resilient tip for bearing against the receiver body.

15. The apparatus as claimed in claim 1, wherein the rear portion has a length greater than the length of said mounting flange.

16. The apparatus as claimed in claim 15, wherein the length of the mounting rail from five inches to nine inches.

17. The apparatus of claim 1, wherein the elongated rail is dimensioned to extend over a weapon sight.

* * * * *